US011572671B2

(12) United States Patent
Viergutz et al.

(10) Patent No.: US 11,572,671 B2
(45) Date of Patent: Feb. 7, 2023

(54) VIRTUAL BOUNDARY SYSTEM FOR WORK MACHINE

(71) Applicant: Caterpillar SARL, Geneva (CH)

(72) Inventors: Michael Aron Viergutz, Bloomington, IL (US); Kensuke Tanaka, Yokohama (JP); Yozo Nakamoto, Tokyo (JP); Carsten Thees, Akashi (JP); Kiesuke Shirani, Akashi (JP)

(73) Assignee: Caterpillar SARL, Geneva (CH)

( * ) Notice: Subject to any disclaimer, the term of this patent is extended or adjusted under 35 U.S.C. 154(b) by 315 days.

(21) Appl. No.: 17/060,924

(22) Filed: Oct. 1, 2020

(65) Prior Publication Data

US 2022/0106767 A1 Apr. 7, 2022

(51) Int. Cl.

| | |
|---|---|
| ***E02F 9/20*** | (2006.01) |
| ***E02F 3/32*** | (2006.01) |
| ***E02F 3/43*** | (2006.01) |
| ***E02F 9/26*** | (2006.01) |

(52) U.S. Cl.

CPC ..... *E02F 9/2033* (2013.01); *E02F 3/32* (2013.01); *E02F 3/435* (2013.01); *E02F 9/2004* (2013.01); *E02F 9/265* (2013.01)

(58) Field of Classification Search

CPC ... E02F 3/32; E02F 3/435; E02F 3/437; E02F 9/2004; E02F 9/2033; E02F 9/24; E02F 9/265

See application file for complete search history.

(56) References Cited

U.S. PATENT DOCUMENTS

| | | | | |
|---|---|---|---|---|
| 5,735,065 | A * | 4/1998 | Yamagata | E02F 3/437 701/50 |
| 6,604,305 | B2 | 8/2003 | Koch | |
| 7,587,264 | B2 | 9/2009 | Furuno et al. | |
| 7,856,299 | B2 | 12/2010 | Fink et al. | |
| 8,527,158 | B2 | 9/2013 | Faivre et al. | |
| 9,222,239 | B2 | 12/2015 | Hartwick | |
| 9,725,874 | B2 | 8/2017 | Meguriya | |
| 9,834,905 | B2 * | 12/2017 | Matsuyama | E02F 3/437 |
| 9,995,020 | B2 | 6/2018 | Yuan et al. | |
| 10,344,450 | B2 | 7/2019 | Sharp | |
| 10,480,160 | B2 | 11/2019 | Tanishige et al. | |

(Continued)

FOREIGN PATENT DOCUMENTS

CN 110091876 B 6/2020

*Primary Examiner* — Tyler J Lee

(74) *Attorney, Agent, or Firm* — von Briesen & Roper, s.c.

(57) ABSTRACT

A machine includes a frame, a plurality of traction devices supporting the frame, an engine and an operator cab mounted to the frame, an implement system configured to move the work tool to a desired position, position sensors, a tilt-rotate system to move the work tool to a desired orientation, orientation sensors, an operator interface, and a control module. The control module is configured to receive a model of the work tool, receive boundary inputs defining a virtual boundary, receive signals from the position sensors and the orientation sensors, receive implement control inputs from the operator interface, determine a position and orientation of the work tool based on the signals and the model, determine whether the work tool is approaching the virtual boundary based on the position and orientation, the boundary inputs, and the implement control inputs, and automatically prevent the work tool from crossing the virtual boundary.

20 Claims, 4 Drawing Sheets

(56) References Cited

U.S. PATENT DOCUMENTS

| | | | | |
|---|---|---|---|---|
| 2010/0223008 | A1 | 9/2010 | Dunbabin | |
| 2016/0138240 | A1* | 5/2016 | Ikegami | E02F 9/26 60/420 |
| 2016/0281331 | A1* | 9/2016 | Ikegami | E02F 3/438 |
| 2018/0340316 | A1* | 11/2018 | Izumikawa | E02F 9/16 |
| 2019/0249391 | A1* | 8/2019 | Kikuchi | E02F 9/22 |
| 2020/0141091 | A1* | 5/2020 | Narikawa | E02F 9/262 |
| 2020/0217050 | A1* | 7/2020 | Chiba | E02F 9/262 |
| 2020/0399862 | A1* | 12/2020 | Okazaki | E02F 9/261 |
| 2021/0230837 | A1* | 7/2021 | Narikawa | E02F 9/262 |
| 2022/0049474 | A1* | 2/2022 | Kanazawa | E02F 9/2203 |

* cited by examiner

VIRTUAL BOUNDARY SYSTEM FOR WORK MACHINE

TECHNICAL FIELD

The present disclosure relates generally to work machines and, more specifically, relates to methods and systems for providing a virtual boundary for a work machine having a work tool.

BACKGROUND

Excavators and other similar work machines must frequently operate in close proximity to obstacles and hazards such as walls, electrical lines, roads, and buried utilities. These machines, which may include any number of construction, excavating, agricultural and industrial work machines, including but not limited to excavators, bulldozers, tractors, and the like, often have work tools with a wide range of movement which may potentially come in contact with these hazards. The need to work in a restricted area poses an increased risk of damage to the machine or its surroundings. In addition, the need to constantly restrict the movement of the machine also puts a strain on operators.

The prior art has failed to adequately address this issue. Although systems such as that disclosed by U.S. Pat. No. 9,725,874 to Meguriya et al. provide some forms of automatic movement limitation, these systems are focused on automating the creation of a level surface at a specific grade. Furthermore, they do not take into account the three-dimensional orientation of the work tool or allow for complex three-dimensional boundaries. In addition, previous boundary systems required assuming a spherical shape of the work tool which limits the precision.

Therefore, there is a need for a work machine having a more refined boundary system.

SUMMARY OF THE DISCLOSURE

According to one aspect of the present disclosure, a machine having a work tool is disclosed. The machine includes a frame, a plurality of traction devices supporting the frame, an engine mounted to the frame, an operator cab mounted to the frame, an implement system configured to move the work tool to a desired position in three dimensions, and having a plurality of position sensors, a tilt-rotate system to move the work tool to a desired orientation in three dimensions, and having a plurality of orientation sensors; an operator interface configured to receive boundary inputs and implement control inputs, and a control module. The control module is configured to receive a three-dimensional model of the work tool, receive boundary inputs defining a virtual boundary from the operator interface, receive signals from the plurality of position sensors and the plurality of orientation sensors, receive implement control inputs from the operator interface, determine a position and orientation of the work tool based on the signals and the model, determine whether the work tool is approaching the virtual boundary based on the position and orientation of the work tool, the boundary inputs, and the implement control inputs, and automatically prevent the work tool from crossing the virtual boundary.

According to another aspect of the present disclosure, a virtual boundary system for a machine having a work tool is disclosed. The system includes an implement system configured to move the work tool to a desired position in three dimensions, and having a plurality of position sensors; a tilt-rotate system to move the work tool to a desired orientation in three dimensions, and having a plurality of orientation sensors; an operator interface configured to receive boundary inputs and implement control inputs; and a control module. The control module is configured to receive a three-dimensional model of the work tool, receive boundary inputs defining a virtual boundary from the operator interface, receive signals from the plurality of position sensors and the plurality of orientation sensors, receive implement control inputs from the operator interface, determine a position and orientation of the work tool based on the signals and the model, determine whether the work tool is approaching the virtual boundary based on the position and orientation of the work tool, the boundary inputs, and the implement control inputs, and automatically prevent the work tool from crossing the virtual boundary.

According to yet another aspect of the present disclosure, a method of controlling a work tool is disclosed. The method includes receiving a three-dimensional model of the work tool, receiving boundary inputs defining a virtual boundary, receiving signals from a plurality of position sensors and a plurality of orientation sensors, receiving implement control inputs from an operator interface, determining a position and orientation of the work tool based on the signals and the model, determining whether the work tool is approaching the virtual boundary based on the position and orientation of the work tool, the boundary inputs and implement control inputs, and automatically preventing the work tool from crossing the virtual boundary.

These and other aspects and features of the present disclosure will be more readily understood after reading the following detailed description in conjunction with the accompanying drawings.

DETAILED DESCRIPTION

Figure 1:
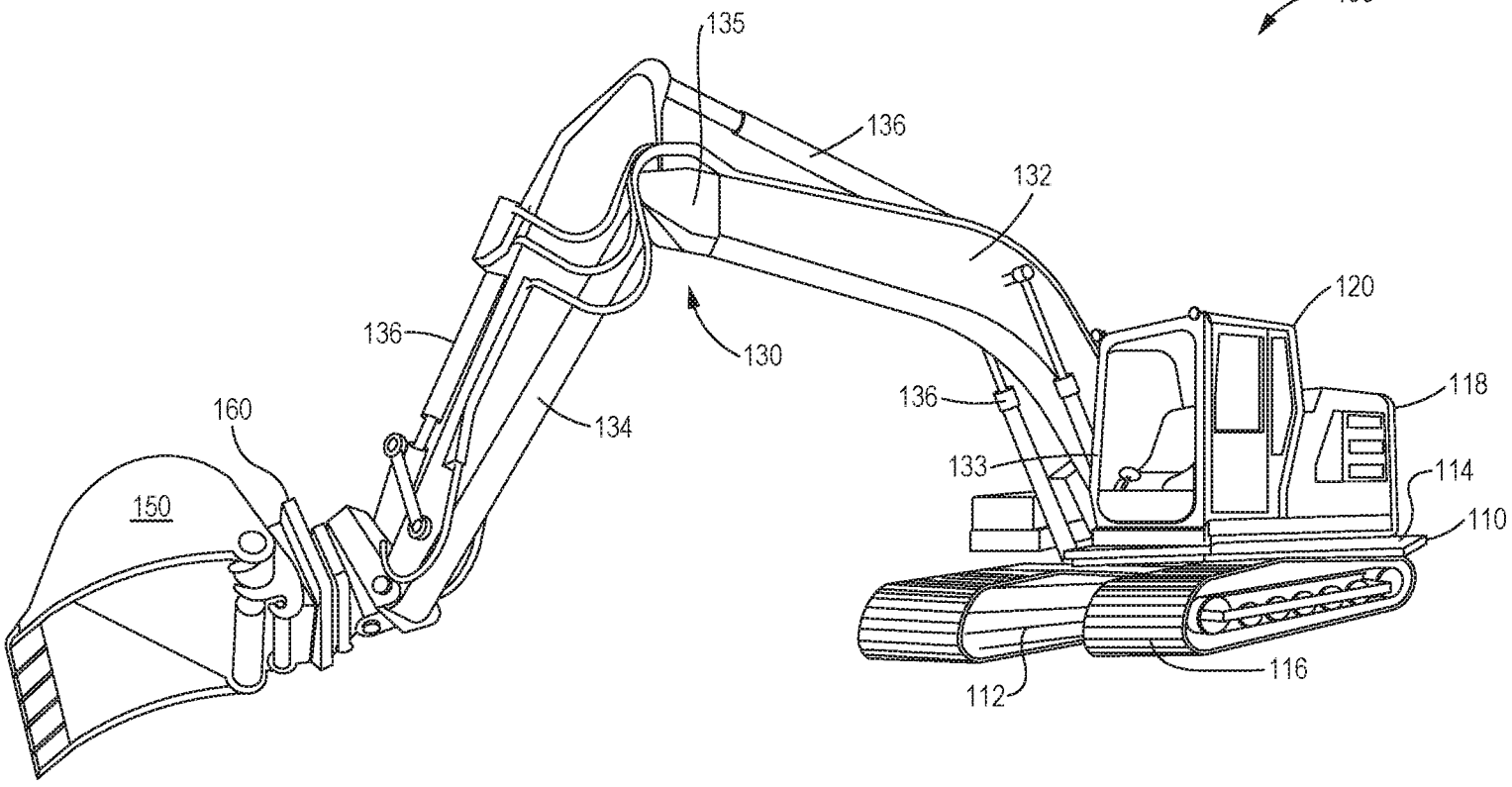
FIG. 1 is a perspective drawing of a work machine, according of aspect of the present disclosure.

Referring now to the drawings, and with specific reference to FIG. 1, an exemplary work machine according to the present disclosure is referred to by reference numeral 100. Specifically, FIG. 1 depicts an excavator, but the work machine 100 may also be other types of construction or excavation machines such as a backhoe, a front shovel, a wheel loader, or another similar machine as well as a material handler. As shown in FIG. 1, the machine 100 includes a frame 110 with a lower section 112 and an upper section 114. The lower section 112 is supported by ground-engaging devices 116 which may be tracks, wheels, or similar. An engine 118 and an operator cab 120 are mounted on the upper section 114.

In addition, the machine 100 has an implement system 130 configured to move a work tool 150 to perform the tasks of the machine 100. The implement system 130 may include a boom 132 and a stick 134. The boom 132 has a first end 133 connected to the upper section 114 of the frame 110 and is vertically pivotable relative to the frame 100. A second end 135 of the boom 132 is connected to the stick 134, which is also vertically pivotable. The boom 132 and stick 134 may be positioned by hydraulic cylinders 136 or any other mechanism capable of moving the parts as needed. The implement system 130 may also include a swing system 140 (not shown) which allows for the movement of the implement system 130 rotationally around the frame 110. The swing system 140 is configured to rotate the upper section 114 of the frame 110 relative to the lower section 112. This allows the lower section 112 of the frame 110 to maintain a stable base while the upper section 114 rotates the implement system 130 to the required angle. The swing system 140 may also be operated by hydraulics 136.

Figure 2:
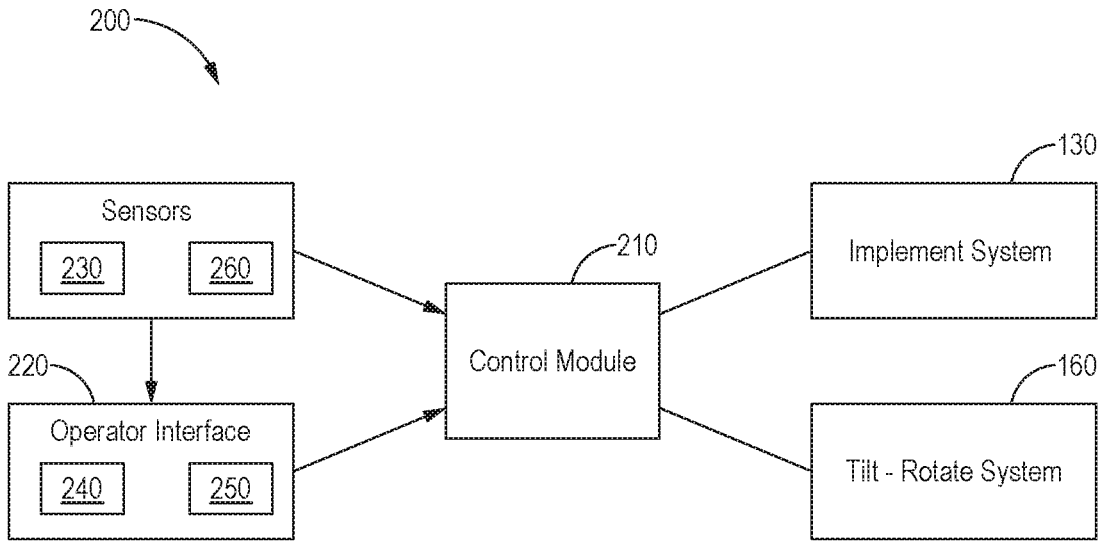
FIG. 2 is a block diagram of a virtual boundary system, according to one aspect of the present disclosure.

The implement system 130 further includes a plurality of position sensors 230. The position sensors 230 may include displacement sensors on hydraulic cylinders, angle sensors at pivot joints, inclinometers, gyroscopic sensors, tilt sensors, global reference sensors, or any other sensor which may contribute to determining the position of the work tool. The position sensors 230 provide signals to a control module 210 (see FIG. 2).

The work tool 150 is attached at an end of the stick 134 furthest from the boom 132 via a tilt-rotate system 160 configured to allow the work tool 150 to be tilted and rotated in multiple dimensions. The work tool 150 illustrated in the figures is a bucket but may alternatively be any device used to perform a particular task including but not limited to a fork arrangement, a blade, a shovel, or any other task-performing device. The tilt-rotate system 160 further includes a plurality of orientation sensors 260, including at least a rotation sensor 252 and a tilt sensor 254. The orientation sensors 260 may include displacement sensors on hydraulic cylinders, angle sensors at pivot joints, inclinometers, gyroscopic sensors, tilt sensors, or any other sensor which may contribute to determining the orientation of the work tool 150.

The movement of the implement system is controlled by the control module 210 based on implement control inputs 240 from an operator in the operator cab 120 through an operator interface 220. The implement control inputs 240 may be provided by joysticks, buttons, a touch interface, or any other device effective for the purpose.

The controls and orientation sensors 260 of the tilt-rotate system 160 are integrated directly into the same control module 210 as the implement system 130. As such, the orientation of the work tool 150 is controlled by the tilt-rotate system 160 through implement control inputs 240 into the operator interface 220 and control module 210. In some other systems, similar tilt-rotate systems include a separate control module which interfaces with a primary machine control module, being a pass through device of the lever commands. If such a separate control module fails, the machine may be inoperable as it will not read and pass through the lever commands Integration of the tilt-rotate system 160 into the control module 210 permits direct access to the sensor information, prevents lag, and allows for more effective diagnosis of errors. In particular, integration allows for partial shut-down and diagnosis in the event of a partial failure, rather than a failure of the entire machine.

Together, the implement system 130 and the tilt-rotator system 160 allow the work tool 150 to be moved to any location and orientation within a three-dimensional range. However, in many applications, there may be portions of that range that should be avoided to prevent damage to or from obstacles and hazards in the area or for other reasons. A virtual boundary system 200 can be used to automatically restrict the work tool from moving beyond the desired range with at least one virtual boundary 300. Shown in FIG. 2, the virtual boundary system 200 includes the position sensors 230 of the implement system 130, the orientation sensors 260 of the tilt-rotate system 160, the operator interface 220, and the control module 210.

Figure 3:
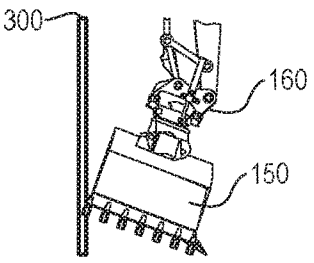
FIG. 3 is a close-up of a work tool of an excavator and a virtual boundary, according to one aspect of the present disclosure

Prior to initiating work, the control module 210 receives a three-dimensional model of the work tool 150. The model includes the dimensions of the work tool 150, including details of the external shape. This allows the system to determine if the work tool 150 is approaching the virtual boundary 300 based on its actual shape rather than an approximation, as shown in FIG. 3. If the work tool 150 is a bucket or similar tools with an interior space, it is not necessary for the model to include the internal shape. In the example of the bucket, the system could determine whether a corner of the teeth, or the back of the bucket is near a virtual boundary.

Figure 4:
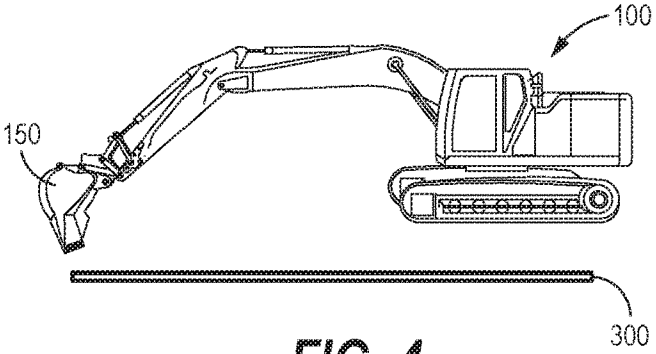
FIG. 4 is a side-view of an excavator and a virtual boundary, according to one aspect of the present disclosure.
Figure 5:
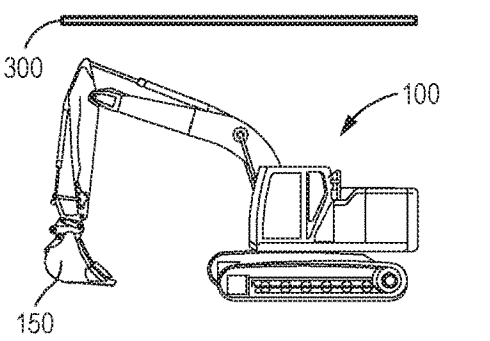
FIG. 5 is a side-view of a work machine and a virtual boundary, according to one aspect of the present disclosure.
Figure 6:
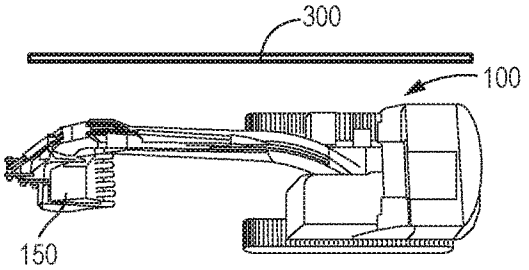
FIG. 6 is a top-view of a work machine and a virtual boundary, according to one aspect of the present disclosure.
Figure 7:
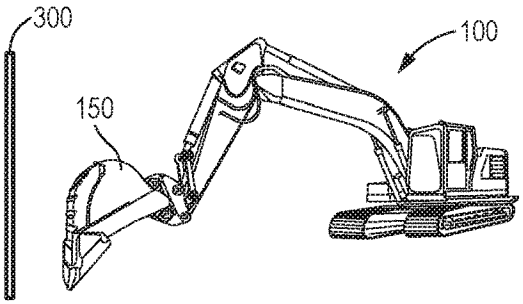
FIG. 7 is a perspective-view of a work machine and a virtual boundary, according to one aspect of the present disclosure.
Figure 8:
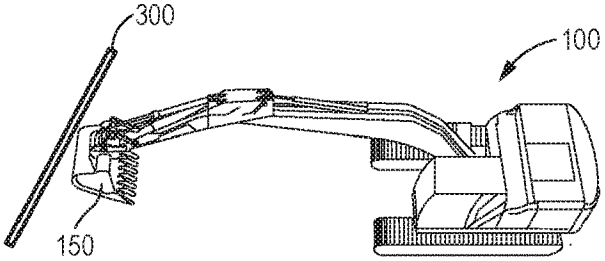
FIG. 8 is a top-view of a work machine and a virtual boundary, according to one aspect of the present disclosure.
Figure 9:
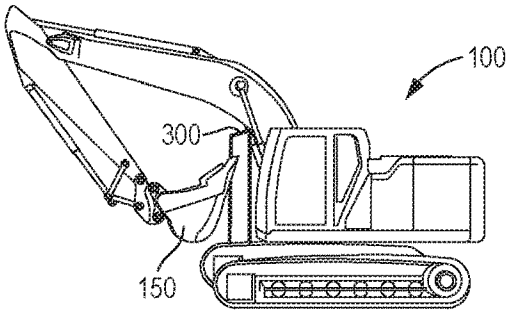
FIG. 9 is a side-view of a work machine and a virtual boundary, according to one aspect of the present disclosure.
Figure 10:
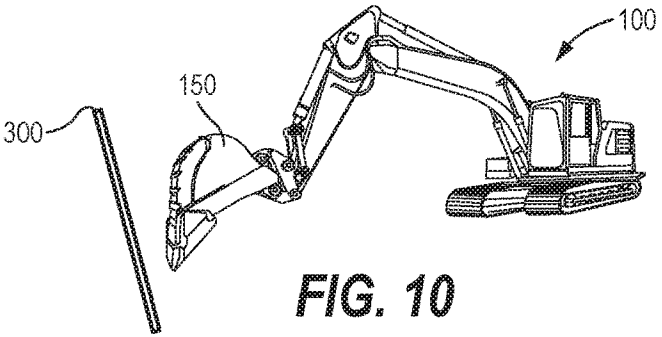
FIG. 10 is a perspective-view of a work machine and a virtual boundary, according to one aspect of the present disclosure.

The control module 210 also receives boundary inputs 250 which define a virtual boundary 300. The boundary inputs 250 may be provided via the operator interface 220. The virtual boundaries 300 are configured as planes which may be oriented in a number of ways. Horizontal planes may be below the machine 100 as a floor, as shown in FIG. 4, or above the machine 100 as a ceiling (FIG. 5). Vertical planes maybe parallel to the boom and stick of the machine 100 to prevent sideways movement (FIG. 6), in front of the machine 100 (FIG. 7), or at any angle between a side wall and a front wall, with one such embodiment show in FIG. 8. A vertical plane may also be used to protect the operator cab 120, as shown in FIG. 9. Finally, the virtual boundary 300 may be a plane which is neither vertical nor horizontal, but instead forms a slope, as shown in FIG. 10. Other boundaries 300 may be conceived which may include a curved shape or other complex shape.

The virtual boundaries 300 may be programmed into the control module 210 as boundary input either manually with measurements including offset, slope, and cross-slope or by placing the bucket at a series of points and setting the plane relative to those positions. Of course, other methods of providing the parameters of the boundary may be used. The boundary 300 may be indicated relative to the machine 100 or as a global reference. The global reference may use global position and orientation from GNSS, or less information, for example elevation only or heading only, such as from a compass. Multiple boundaries may be input in order to completely define the work area.

When the machine 100 is operating, the control module 210 receives signals from the plurality of position sensors 230 and the plurality of orientation sensors 260. These signals allow the control module 210 to determine the precise position and orientation of the work tool 150 in a three-dimensional space. Combined with the model of the work tool 150, this allows for precise knowledge of the location of all the edges and extremities of the work tool 150.

The control module 210 also receives implement control inputs 240 from the operator interface 220. These inputs represent the action an operator is directing the implement system 130 and the tilt-rotate system 160 to take.

Next, the control module determines whether the work tool 150 is approaching the virtual boundary 300 based on the determined position and orientation of the work tool 150, and the boundary 250 and implement control inputs 240.

Finally, the work tool 150 is automatically prevented from crossing the virtual boundary 300. This is accomplished by halting any motion of the implement system 130 or tilt-rotate system 160 despite any further implement control inputs 240 in that direction by the operator. Implement controls inputs 240 directing motion away from the virtual boundary 300 is not affected.

The virtual boundary system 200 may further include an alert if the work tool 150 approaches within a threshold distance of the virtual boundary 300. This alert may be a visual or auditory indicator in the operator cab 120.

INDUSTRIAL APPLICABILITY

Work machines such as excavators and other earth-moving and construction machines must frequently operate in close proximity to obstacles and hazards such as walls, electrical lines, roads, and buried utilities. The need to work in a restricted area puts a strain on operators who must constantly monitor the movement of the machine. In addition, these conditions pose an increased risk of damage to the machine, its surroundings, and even bystanders. A virtual boundary system 200 may be useful in any application in which a work tool must work in a restricted space. This may include construction, mining, farming, and similar industries.

Figure 11:
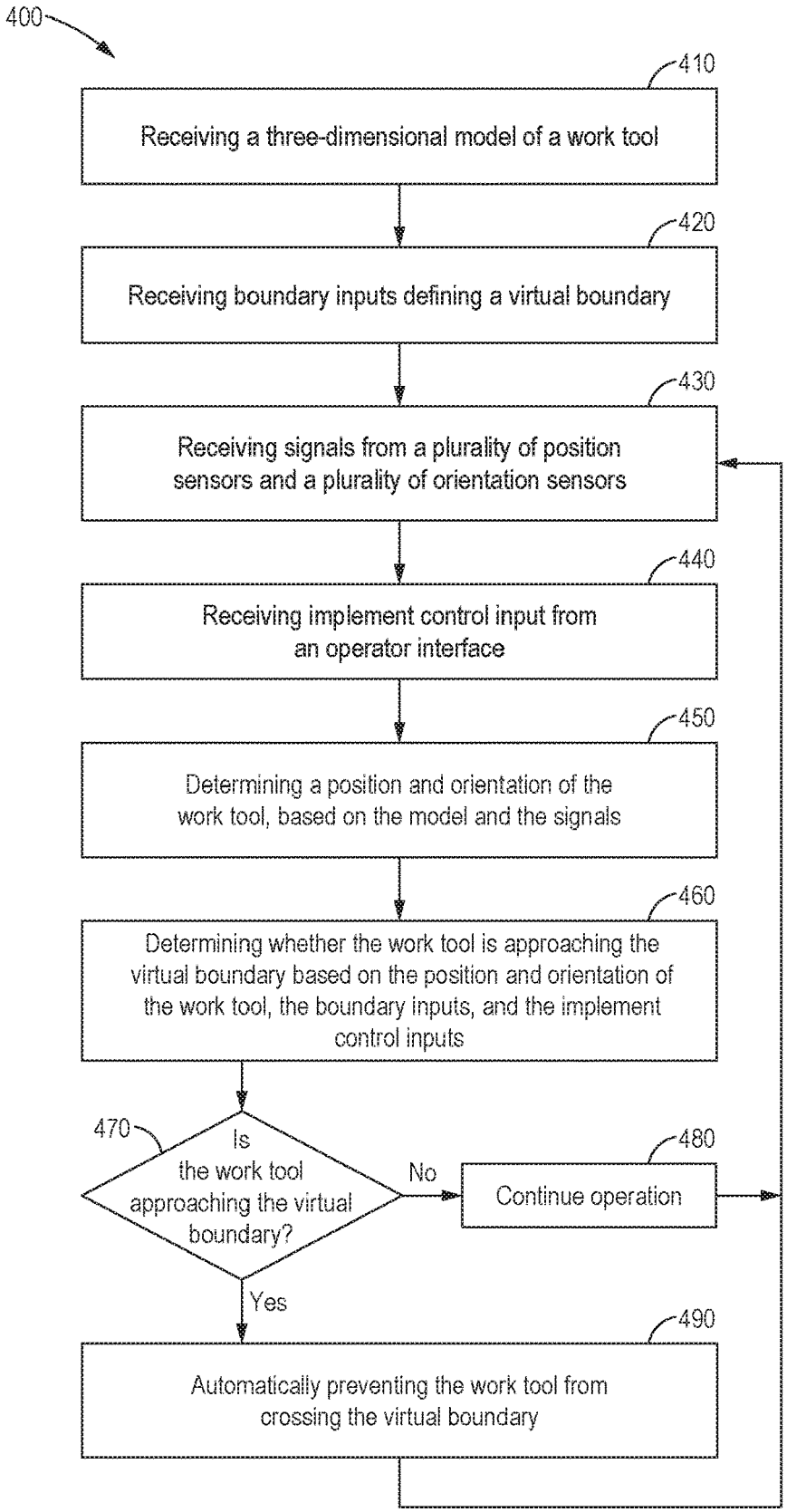
FIG. 11 is a flow diagram of a method of limiting the movement of a work tool, according to one aspect of the present disclosure.

The virtual boundary system 200 uses the following method 400, as depicted in FIG. 11. Prior to initiating work, the control module 210 receives a three-dimensional model of the work tool 150 (block 410). The model includes the dimensions of the work tool, including details of the shape. This allows the system to determine if the work tool is approaching the barrier based on its actual shape and three-dimensional orientation rather than an approximation.

The control module 210 also receives boundary inputs from an operator interface which define a virtual boundary 300 (block 420). The virtual boundary 300 may be defined by an offset, slope, and cross slope which may be entered manually as measurements or by placing the work tool at points across the plane. The measurements may be defined relative to the machine 100, or as a global reference. The virtual boundary 300 may have a planar shape.

When the machine 100 is operating, the control module 210 receives signals from a plurality of position sensors 230 and a plurality of orientation sensors 260 (block 430). The control module 210 also receives implement control inputs from the operator interface 220, as shown in block (440). These inputs represent the action an operator is directing the implement system 130 and the tilt-rotate system 160 to take.

Based on the signals, the control module 210 determines the position and orientation of the work tool 150 in three-dimensions (block 450). Next, as shown in block 460, the control module determines whether the work tool 150 is approaching the virtual boundary 300 based on the position and orientation of the work tool 150 (as determined in block 450), and the boundary and implement control inputs. If the work tool is approaching the virtual boundary (block 470), the work tool 150 is automatically prevented from crossing the virtual boundary 300, as shown in block 480. This is accomplished by halting any motion of the implement system 130 or tilt-rotate system 160 despite any further operator input in that direction. On the other hand, if the work tool is not approaching the virtual boundary, normal operations of the machine 100 continue (block 490) Operator input directing motion away from the virtual boundary 300 is not affected.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A machine, comprising:
- a frame;
- a plurality of traction devices supporting the frame;
- an engine mounted to the frame;
- an operator cab mounted to the frame;
- an implement system connected to the frame, the implement system configured to move a work tool to a desired position in three dimensions, and having a plurality of position sensors;
- a tilt-rotate system, the tilt-rotate system configured to move the work tool to a desired orientation in three dimensions, and having a plurality of orientation sensors;
- an operator interface configured to receive boundary inputs and implement control inputs; and
- a control module configured to:
  - receive a three-dimensional model of the work tool,
  - receive boundary inputs defining a virtual boundary from the operator interface,
  - receive signals from the plurality of position sensors and the plurality of orientation sensors,
  - receive implement control inputs from the operator interface,
  - determine a position and orientation of the work tool based on the signals and the model,
  - determine whether the work tool is approaching the virtual boundary based on the position and orientation of the work tool, the boundary inputs, and the implement control inputs, and
  - automatically prevent the work tool from crossing the virtual boundary.

2. The machine of claim 1, wherein the tilt-rotate system controls and sensors are integrated directly into the control module.

3. The machine of claim 1, wherein more than one virtual boundary is defined.

4. The machine of claim 1, wherein the virtual boundary is a planar shape.

5. The machine of claim 1, wherein the virtual boundary is defined by an offset, a slope, and a cross slope.

6. The machine of claim 1, wherein the virtual boundary is defined relative to the machine.

7. The machine of claim 1, wherein the virtual boundary is defined by a global reference.

8. A virtual boundary system for a machine having a work tool, comprising:

an implement system, the implement system configured to move the work tool to a desired position in three dimensions, and having a plurality of position sensors;

a tilt-rotate system, the tilt-rotate system configured to move the work tool to a desired orientation in three dimensions, and having a plurality of orientation sensors;

an operator interface configured to receive boundary inputs and implement control inputs; and a control module configured to:

receive a three-dimensional model of the work tool, receive boundary inputs defining a virtual boundary from the operator interface, receive signals from the plurality of position sensors and the plurality of orientation sensors, receive implement control inputs from the operator interface, determine a position and orientation of the work tool based on the signals and the model, determine whether the work tool is approaching the virtual boundary based on the position and orientation of the work tool, the boundary inputs, and the implement control inputs, and automatically prevent the work tool from crossing the virtual boundary.

9. The system of claim 8, wherein the tilt-rotate system controls and sensors are integrated directly into the control module.

10. The system of claim 8, wherein more than one virtual boundary is defined.

11. The system of claim 8, wherein the virtual boundary is a planar shape.

12. The system of claim 8, wherein the virtual boundary is defined by an offset, a slope, and a cross slope.

13. The system of claim 8, wherein the virtual boundary is defined relative to the machine.

14. The system of claim 8, wherein the virtual boundary is defined by a global reference.

15. A method of controlling a work tool, comprising:

receiving a three-dimensional model of the work tool;

receiving boundary inputs defining a virtual boundary;

receiving signals from a plurality of position sensors and a plurality of orientation sensors;

receiving implement control inputs from an operator interface;

determining a position and orientation of the work tool based on the signals and the model;

determining whether the work tool is approaching the virtual boundary based on the position and orientation of the work tool, the boundary inputs and implement control inputs, and automatically preventing the work tool from crossing the virtual boundary.

16. The method of claim 15, wherein more than one virtual boundary is defined.

17. The method of claim 15, wherein the virtual boundary is a planar shape.

18. The method of claim 15, wherein the virtual boundary is defined by an offset, a slope, and a cross slope.

19. The method of claim 15, wherein the virtual boundary is defined relative to the machine.

20. The method of claim 15, wherein the virtual boundary is defined by a global reference.

* * * * *